US009488163B2

(12) United States Patent
Caldwell et al.

(10) Patent No.: US 9,488,163 B2
(45) Date of Patent: Nov. 8, 2016

(54) FLUID CONTROL SYSTEM

(75) Inventors: Niall James Caldwell, Edinburgh (GB); William Hugh Salvin Rampen, Edinburgh (GB)

(73) Assignees: Artemis Intelligent Power Limited, Loanhead Lothian (GB); Sauer-Danfoss APS, Nordborg (DK)

( * ) Notice: Subject to any disclaimer, the term of this patent is extended or adjusted under 35 U.S.C. 154(b) by 629 days.

(21) Appl. No.: 13/390,471

(22) PCT Filed: Aug. 11, 2010

(86) PCT No.: PCT/GB2010/051328

§ 371 (c)(1),
(2), (4) Date: Feb. 14, 2012

(87) PCT Pub. No.: WO2011/018660

PCT Pub. Date: Feb. 17, 2011

(65) Prior Publication Data

US 2012/0141303 A1 Jun. 7, 2012

(30) Foreign Application Priority Data

Aug. 14, 2009 (GB) ..... 0914224.1

(51) Int. Cl.
*F04B 1/00* (2006.01)
*F04B 1/04* (2006.01)

(52) U.S. Cl.
CPC ..... *F04B 1/0452* (2013.01); *F04B 1/00* (2013.01)

(58) Field of Classification Search
CPC .. F04B 11/00; F04B 11/0008; F04B 11/0016
USPC ..... 417/270, 540, 543; 91/478, 491, 497; 138/26, 30, 31; 137/514.5
See application file for complete search history.

(56) References Cited

U.S. PATENT DOCUMENTS 4,161,189 A 7/1979 Mueller, Jr.
4,252,141 A * 2/1981 Burgdorf ..... B60T 13/148 137/101

(Continued)

FOREIGN PATENT DOCUMENTS

DE 102009006980 A1 * 8/2009
EP 0083403 A1 7/1983

(Continued)

OTHER PUBLICATIONS

GB Search Report for Application No. GB0914224.1, dated Dec. 22, 2009.

(Continued)

*Primary Examiner* — Patrick Hamo
(74) *Attorney, Agent, or Firm* — Meunier Carlin & Curfman LLC

(57) ABSTRACT

The present invention provides a fluid system (99) comprising a source of hydraulic fluid under pressure supplying a hydraulic fluid consumer (103) together with a valve passing fluid between said source and said fluid consumer (102). A first fluid compliance (105) is situated between said source (100) and said valve (102) and a variable restrictor (110) is provided for varying the cross sectional area available for flow of fluid through said valve (102) and is movable between a first position (A) with a larger said area and a second position (B) with a smaller said area. A bias means (117) biases said restrictor (110) towards said second position while an opening means (Fa) urges said restrictor (110) against said bias (117) when fluid flows through said valve (102) and a damping means (126) damps movement of said restrictor between said first and second positions and provides a resistance which increases with the velocity of displacement of said restrictor (110).

17 Claims, 5 Drawing Sheets

(56) References Cited

U.S. PATENT DOCUMENTS

| | | | | |
|---|---|---|---|---|
| 5,183,075 | A * | 2/1993 | Stein | F02M 59/462 137/493.6 |
| 6,651,545 | B2 | 11/2003 | Nippert | |
| 2006/0039795 | A1* | 2/2006 | Stein et al. | 417/1 |
| 2011/0017332 | A1* | 1/2011 | Bartsch et al. | 138/30 |
| 2013/0231651 | A1* | 9/2013 | Burr et al. | 606/21 |

FOREIGN PATENT DOCUMENTS

| | | | |
|---|---|---|---|
| EP | 0361927 | A1 | 4/1990 |
| EP | 0494236 | | 7/1992 |
| EP | 1319835 | A2 | 6/2003 |
| EP | 1537333 | B1 | 6/2006 |
| EP | 2055944 | A1 | 5/2009 |
| FR | 2362325 | A1 | 3/1978 |
| GB | 1445910 | A | 8/1976 |
| GB | 2160950 | A | 1/1986 |
| WO | 2007088106 | | 8/2007 |

OTHER PUBLICATIONS

International Search Report for International Application No. PCT/GB2010/051328, mailed Mar. 11, 2010.

* cited by examiner

FLUID CONTROL SYSTEM

The present invention relates to a fluid system and relates particularly but not exclusively to a fluid system for driving a hydraulic load.

STATEMENT OF PROBLEM

In fluid power systems for mobile vehicles, it is common that a variable flow source driven by a prime mover supplies fluid to actuators (such as hydraulic motors or linear cylinders), often via a system of valves. In a typical positive-displacement pump used as a variable flow source, the flow output is the summation of flows from a number of separate working chambers which are separated in phase angle from each other. Typically these flows are half-rectified sinusoids and, although seven or more working chambers are used, there is a degree of high-frequency pulsation (where 'high-frequency' is defined as a frequency above the prime mover shaft frequency of rotation) in the output flow. However, for these machines, the amount of high-frequency pulsation is low compared to the average steady flow. When it is desired that the flow from the source is variable, typically the stroke of the working chambers is modulated. This has the effect of reducing in proportion the flows from the working chambers, such that as the flow reduces, so does the much of the high-frequency fluid pulsation.

However, a new class of fluid power system is emerging in which the flow source exhibits considerably more high-frequency pulsation than the typical variable-stroke positive displacement pump. These flow sources are being developed because they have increased energy efficiency and controllability compared to traditional flow sources. One such source is the so-called Digital Displacement or synthetically commutated pump (see EP 0361927 B1, EP 0494236 B1 and EP 1537333). This is a positive displacement fluid pump in which the flow outputs of each working chamber are controlled on a stroke-by-stroke basis by an electronic controller, by means of high-speed valves capable of responding to an electronic demand. In such machines, control of the flow output is varied by the controller varying the timing of commutation, and the time-averaged proportion of working chambers which are connected to the output. Such pumps are more efficient and controllable than typical variable-stroke pumps. A similarly operating pump is also described in U.S. Pat. No. 6,651,545. When such flow sources are used in typical fluid power systems, it may be found that the increased high-frequency flow pulsation causes unacceptable noise or vibration. As well as being an inconvenience to the operator and other people near the machine, this may also reduce the lifetime of components of the fluid system such as fittings, filters or hoses, and therefore may reduce the safety of the machine.

GB 2160950 discloses a hydraulic damper valve for fitting in the return line of a pulsed-flow hydraulic circuit, for example a cam packer used in mining operations. The valve element remains seated until a flow pulse impinges thereon, and returns to its seated position after the flow ceases. EP0083403 discloses a damped poppet type pressure relief valve, wherein the damping is provided by a volume of trapped fluid. The device provides a continuous leakage from inlet to outlet or vice versa.

It is well known that attenuation of fluid pulsation can be achieved by increasing the system compliance by means of, for instance, an oleopneumatic accumulator. However large fluid compliances add cost and weight, as well as slowing down the dynamic response of the system.

It is also well known that attenuation of fluid pulsation can be achieved by inserting a fixed restriction between the flow source and the actuator. However this has the disadvantage of causing large amounts of energy to be wasted due to the pressure drop across the restriction, especially when the flow rate is high.

It is therefore an object of the invention to achieve the advantages of the above-described flow sources compared to the typical variable-stroke pump, without unacceptable noise or vibration, and without the cost and dynamic disadvantages of a large fluid compliance or the energy wastage of a fixed restrictor.

DESCRIPTION OF THE INVENTION

Accordingly, the present invention provides a fluid system comprising a source of hydraulic fluid under pressure, a hydraulic fluid consumer, a valve passing fluid between said source and said fluid consumer, a first fluid compliance between said source and said valve, a variable restrictor for varying the cross sectional area available for flow of fluid through said valve and movable between a first position (A) with a larger said area and a second position (B) with a smaller said area, a bias means for biasing said restrictor towards said second position; an opening means for urging said restrictor against said bias when fluid flows through said valve and a damping means for damping movement of said restrictor between said first and second positions and providing a resistance which increases with the velocity of displacement of said restrictor.

Preferably the opening means comprises a surface of the restrictor, said restrictor surface being arranged in or adjacent to the flow of fluid through said valve or otherwise being acted on by fluid pressure from fluid flowing through said valve. However, it will be appreciated that other forms of opening means such as a solenoid actuation valve or variable control actuator or such similar device may be employed for the same purpose.

Preferably the fluid system includes a controller for controlling said source. Preferably said controller is an electronic controller. Preferably said controller is operable to control the fluid flow from said source.

Preferably said source produces in use a varying flow comprising a plurality of local flow maxima and local flow minima separated by at least a minimum time Ta, and a time constant Tr of the damped restrictor movement is longer than Ta. Said time constant Tr may be the time required for said restrictor to move 63% of the distance from its starting position to its final position after an infinitely persisting step change in flow through said valve, or for the cross-sectional area to change by 63% of the area difference between its starting position and its final position after the same step in flow.

Preferably said local flow minima are separated by at least a minimum time Tb from temporally adjacent local flow mimina, and the time constant Tr of the damped restrictor movement is longer than Tb.

Preferably said source comprises a plurality of working chambers connectable to and isolatable from said valve, thereby to cause the source to produce a varying flow comprising a plurality of local flow maxima and local flow minima. Preferably said controller is operable to add working chambers to, delete working chambers from or either add working chambers to or delete working chambers from a set of working chambers connected to the valve no more frequently than an interval Td, and the time constant Tr of the damped restrictor movement is longer than Td.

Preferably said source comprises a plurality of working chambers which produce flow pulses separated by a non-zero minimum time Tp, and the time constant Tr of the damped restrictor movement is longer than Tp.

Preferably said source produces a varying flow comprising a plurality of local flow maxima and local flow minima formed by a summation of flow pulses, each of said flow pulses having a maximum length Tc, and the time constant Tr of the damped restrictor movement is longer than Tc.

Preferably said source is a pulsative flow source producing in use a varying flow comprising a plurality of local flow maxima and local flow minima, and one or more short repeating flow patterns each having the same average flow and having a maximum period Tf, wherein preferably the time constant Tr of the damped restrictor movement is longer than Tf.

Tr may also be twice, three times or four times any of Ta, Tb, Tc, Td and Tf.

Preferably at least one said local flow minimum is substantially zero, in at least some operating conditions. Where said source is a positive displacement fluid working machine, said local flow maxima flows may be a local maximum of flow from one or more working chambers of said positive displacement fluid working machine. Where said source is a positive displacement fluid working machine, any said periods Ta, Tb, Tc, Td and Tf may be shorter than one, two or three cycles of working chamber volume, and may be longer than one, two or three cycles in some operating modes. Where said source is a positive displacement fluid working machine, it may be that two of the at least two local flow minima are separated by a longer time than the working chamber passing period.

Preferably said source is a variable flow source producing in use a time-averaged output flow, said time averaged output flow following a demand signal and having a maximum bandwidth of 1/Ts, wherein the time constant of the damped restrictor movement is less than Ts. Said source may produce a slowly varying average flow that varies between a minimum average flow and maximum average flow in no less than a transition time Ts, where Ts is a substantially longer time than Tf, Ta, Tb, Tc or Td, and where the time constant Tr of the restrictor movement lies between Tf, Ta, Tb, Tc, or Td, and Ts. Ts may be twice, three times or four times Tr.

Said fluid consumer may comprise one or more motors or actuators.

The fluid system may further comprise a second fluid compliance between said valve and said fluid consumer.

Any of said fluid compliances may comprise an hydraulic accumulator.

Preferably said restrictor comprises a spool having a first, flow confronting, surface of fixed cross-sectional area and a variable outlet area at a second end thereof, the area of which depends upon the axial position of said spool relative to the body of said valve, thereby to create a variable pressure drop across said valve. Said cross-sectional area available for flow may reduce to zero in position B, or an opening may be left. Pressure upstream or downstream of the variable orifice may be used to move the restrictor against the biasing means.

Preferably said biasing means comprises a spring. Preferably said bias means provides a substantially constant biasing force. By substantially constant biasing force is meant that the ratio of forces applied on the valve head by the bias means at position A and at position B is less than 4:1, less than 3:1, less than 2:1, less than 3:2 or less than 4:3. Preferably said biasing means is located apart from the flow of working fluid through said valve, preferably on the opposite side of said restrictor to said flow of working fluid.

Preferably said damping means comprises a volume of working fluid trapped between said spool and the body of said valve. Preferably said damping means provides no resistance when said restrictor is stationary, and provides resistance opposing restrictor movement. Said damping means may provide resistance proportional to restrictor velocity, a resistance depending on said restrictor's position between positions A and B, a resistance that varies non-linearly with restrictor velocity, and a resistance that varies with pressure and/or flow through the valve. Said damping means may provide a resistance to movement that decreases or remains substantially the same when the pressure difference across the restrictor or said damping means or any other two volumes of fluid within the valve reaches or exceeds a threshold.

Any of said biasing means, said damping means or said opening means may comprise an electronically controlled actuator, such as a solenoid/electromagnetic actuator, a piezoelectric actuator, an electrorheological device or a hydraulic amplifier ('pilot stage'). Said electronically controlled actuators may be controlled and varied in use by said controller.

It may be that said valve is a dual-mode valve which is operable at least some of the time to control the flow of fluid therethrough, preferably by varying the pressure drop across the variable restrictor, preferably under the control of an electronic controller which might be the controller for controlling the source. It may also be that the fluid system comprises a plurality of said dual-mode valves each connected to different said hydraulic fluid consumers.

Preferably the sum of fluid flows through said plurality of dual-mode valves is substantially the same as the fluid flow from said source of hydraulic fluid. Preferably said plurality of dual-mode valves are controllable so as to vary the proportion of flow going to each hydraulic consumer from said source of hydraulic fluid.

Preferably said source comprises a plurality of working chambers of cyclically varying volume controlled on a stroke-by-stroke basis by said controller, by means of high-speed commutating valves associated with each working chamber and controlled so as to vary the time-averaged proportion of working chambers which provide fluid to or from said valve. A pulsative flow source is preferably a positive displacement fluid pump or motor. Said source may be a fluid pump or motor in which the flow output is alternately connected to and disconnected from its input by a switching valve under the control of said controller. In such machines, control of the flow output may be achieved by varying the proportion of time that the output is disconnected from the input.

PARTICULAR DESCRIPTION

The present invention will now be more particularly described by way of example with reference to the accompanying drawings, in which.

Figure 1:
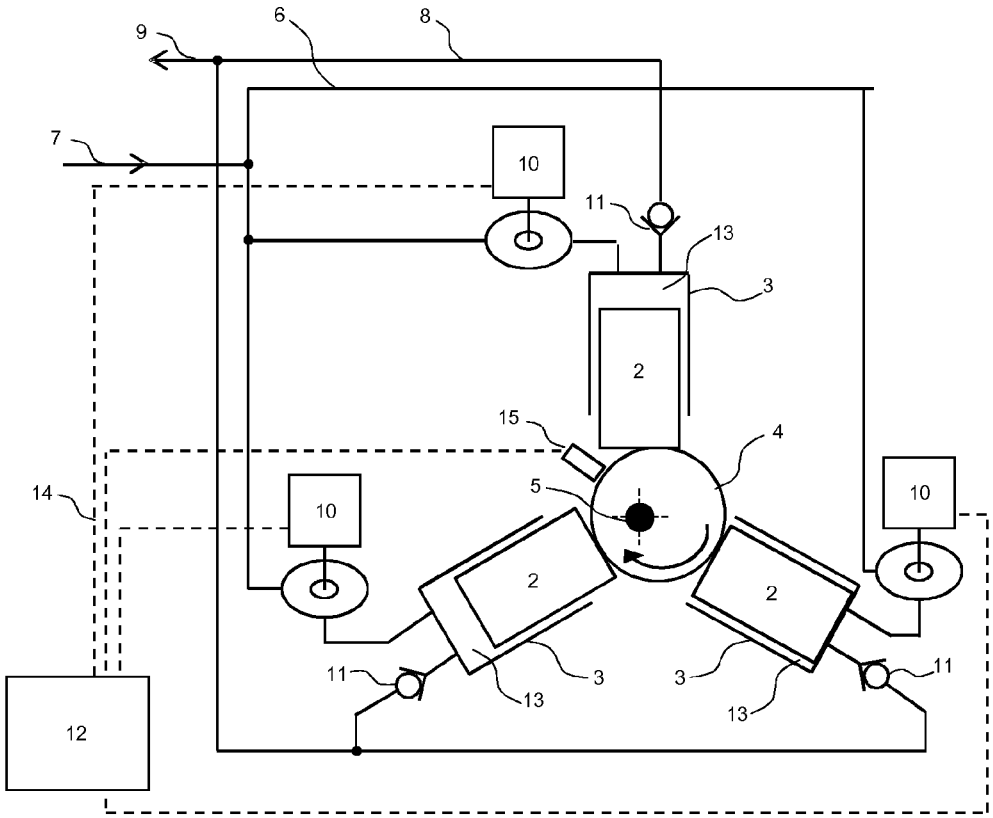
FIG. 1 is a schematic representation of one source of fluid in the form of a Digital Displacement Pump known in the art.

The reader's attention is now drawn to FIG. 1 which illustrates a Digital Displacement Pump 1 in detail and from which the reader will appreciate that it comprises a reciprocating piston pump arrangement having one or more pistons 2 provided in one or more cylinders 3, together forming working chambers 13. The pistons 2 are driven from an eccentric cam arrangement 4 which is, in turn, driven by a prime mover such as an engine via shaft 5. An inlet manifold 6 may be provided when a multi cylinder arrangement is used and said manifold acts to receive low pressure hydraulic fluid from a reservoir via low pressure port 7. The outlet side may also be provided with a high pressure manifold which is shown at 8 and connected for receiving pressurized fluid from the cylinders 3 and for supplying it to a high pressure port 9. Preferably, the pump 1 comprises a Digital Displacement Pump (DDP) of the positive displacement type commutated by inlet and outlet valves shown generally at 10 and 11 respectively which are of the type discussed in more detail later herein and which together with the working chambers provide discrete pulses of high pressure fluid to high pressure manifold 8 and thence to the high pressure port 9. A controller 12, shaft sensor 15 for measuring shaft 5 position and speed and therefore working chamber 13 volume, and control signals 14 are provided for causing opening and closing of the various inlet and outlet valves 10, 11 as and when required so as to deliver full or partial chamber volumes or no volume at all, as discussed with reference to FIGS. 2 and 3.

Each working chamber 13 of the pump 10 has two modes of operation: pumping and idling. When used in the pumping mode fluid is positively driven out of the pump 10 by the controller 12 closing the inlet valve 10 which causes fluid to be driven out of a working chamber and supplied to the high pressure port 9. When the pump is operated in idle mode the inlet valve is maintained open and fluid within a working chamber returns to the inlet manifold 6 for subsequent re-use. The controller 12 decides, on a stroke-by-stroke basis, whether a working chamber should execute a pumping or idling stroke and actuates the solenoid valves 10 accordingly in synchronism with the shaft 5. Control of fluid displacement of the machine may be achieved by varying the time-averaged proportion of working chambers which execute pumping strokes, compared to those which execute idling strokes, and also by modulating the timing of the valve actuations.

Pumping Profiles

Figure 2:
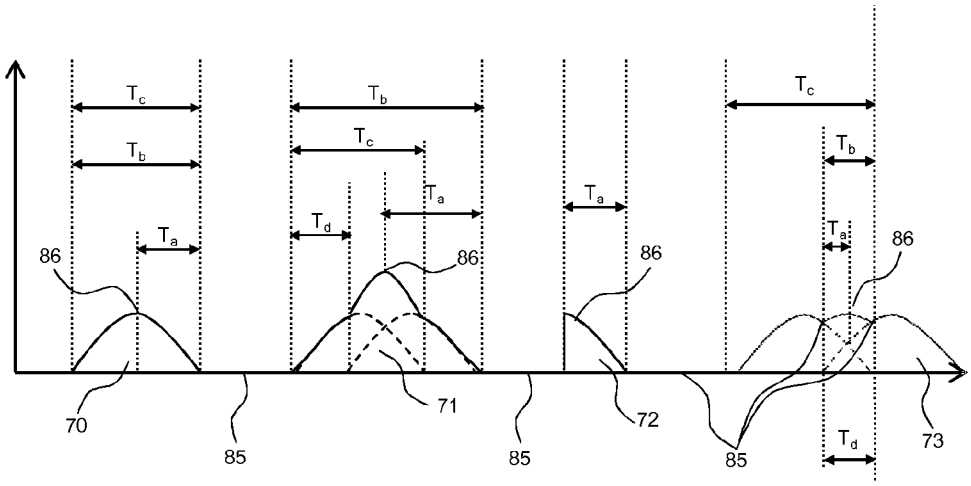
FIGS. 2 and 3 are graphical representation of the pulsed output from the Digital Displacement Pump of FIG. 1.

FIG. 2 illustrates some possible fluid flow profiles of the Digital Displacement Pump (1). In FIG. 2 the graph shows a series of flow pulses 70,71,72,73 caused by working chambers 13 being used in the pumping mode, and shows the local flow minima 85 and maxima 86 associated with the aggregate flow. 70 is the profile of one working chamber; 71 of two working chambers in which the flow pulses from each overlaps to produce a larger flow peak 86; 72 of a partial working chamber; and 73 of two working chambers in which the flow pulses from each overlaps to produce a third flow peak 86. The shortest time between each local flow minimum 85 and the adjacent local flow maximum 86 are shown as times Ta. The shortest time between each local flow minimum 85 and the next adjacent local flow minimum 85 is shown as times Tb. The shortest length of a flow pulse from a working chamber is shown as time Tc. The shortest time between adding or deleting working chambers from the set of active pumping working chambers is shown as time Td.

Figure 3:
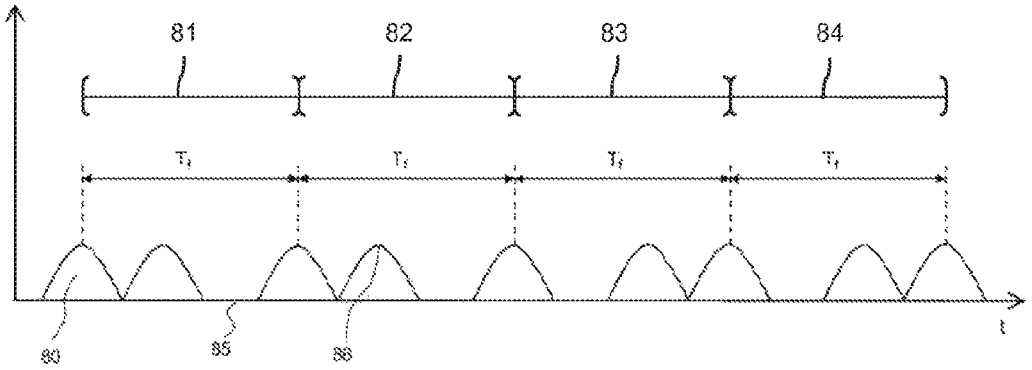

We now draw the reader's attention to FIG. 3 which illustrates some additional possible pumping profiles of the Digital Displacement Pump. In FIG. 3 the profile is such as to produce a series of discrete pulses 80 forming repeating patterns 81,82,83,84 each of period Tf and each having the same average flow (although some patterns are different from others). Each pulse 80 represents the fluid delivered by a single working chamber 13 of the Digital Displacement Pump 1, but if there is a time when no working chambers deliver fluid there may be at least one local minimum instantaneous flow 85 which may be essentially zero. At any time the Digital Displacement Pump may be controlled so as to switch to a different repeating pattern with a different average flow.

It will be obvious that Ta, Tb, Tc, Td and Tf of course depend on the speed of shaft 5 rotation and the flow pattern, which are under the designer's control, and each may be greater than, equal to or less than the period of shaft 5 rotation.

Whilst the above-described arrangement and valves provide a perfectly acceptable arrangement for the vast majority of operational requirements, it has been found that, in certain extreme conditions the pulsing of the fluid supply can cause an undesirable behaviour of a downstream hydraulic fluid consumer, for example a motor or hydraulic cylinder. The rapid variation of the fluid flow may also cause downstream control valves to "flutter", that is to say oscillate between open and closed, exacerbating the undesirable behaviour.

System of the Invention

Figure 4:
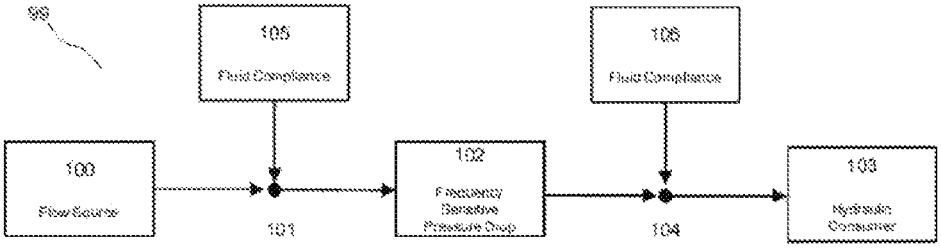
FIG. 4 is a schematic representation of a fluid system in accordance with an aspect of the present invention.

Referring now to FIG. 4, which illustrates the present invention, it will be appreciated that the flow source 100 may comprise the Digital Displacement Pump as described above or may comprise another such pulsative flow source. Whatever the source, the fluid is provided via line 101 to a frequency sensitive pressure drop (FSPD) 102 (acting as the valve) to be discussed later herein and thence to a fluid consumer 103 via supply line 104. Between the flow source 100 and the FSPD 102 there is provided a first compliance 105 which may take any one of a number of acceptable forms and the function of which will be discussed later. An optional and additional second compliance 106 may be provided between the FSPD 102 and the fluid consumer 103.

FSPD

Figure 5:
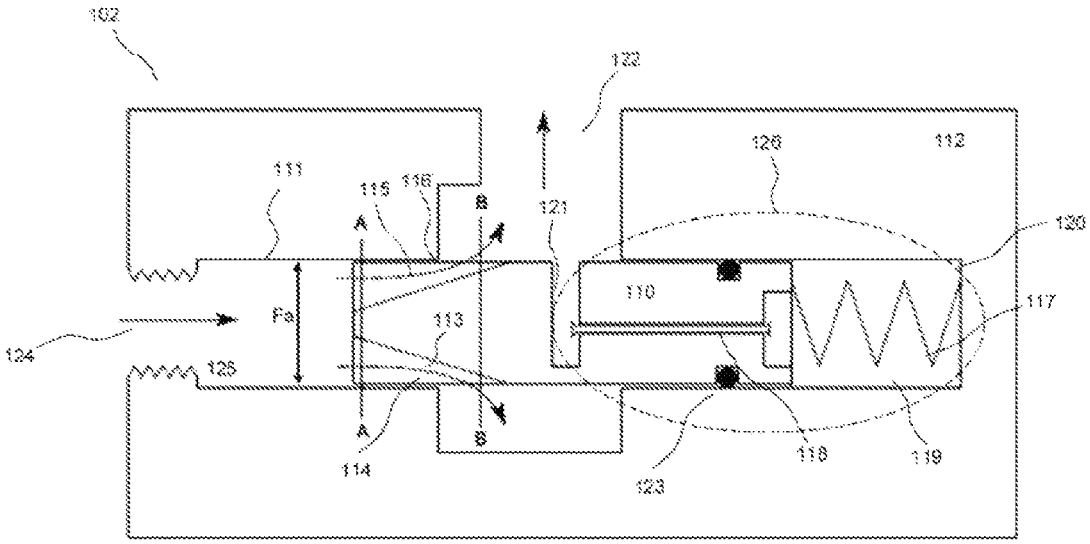
FIG. 5 is a diagrammatic illustration of a frequency sensitive pressure drop arrangement suitable for use in FIG. 4.
Figure 6:
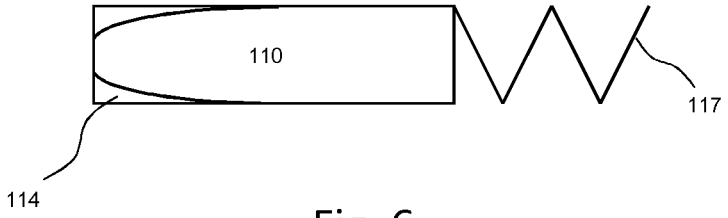
FIGS. 6 and 7 illustrate a two alternative spool profiles as may be used to give the valve different flow characteristics.
Figure 7:
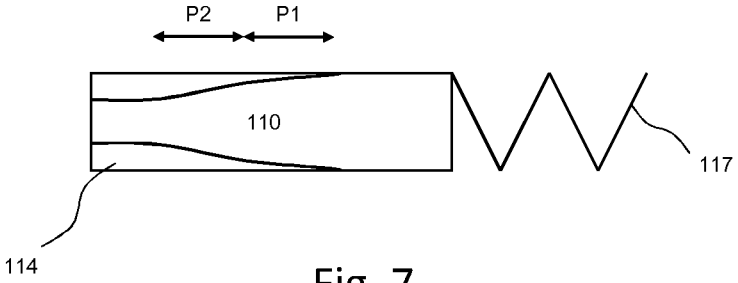
Figure 8:
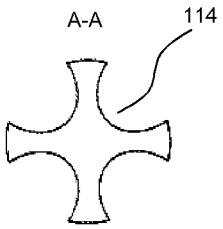
FIGS. 8 and 9 are cross-sectional views taken in the direction of arrows A-A and B-B of FIG. 5.
Figure 9:
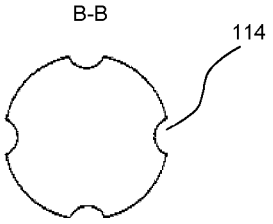

FIGS. 5 to 9 are schematic representations of various parts of the FSPD 102 and will now be described in turn before the operation of the overall system is described. Referring to FIG. 5, it will be seen that the FSPD 102 may comprise a spool valve arrangement comprising a spool (110) (acting as the variable restrictor) axially displaceable within an aperture (111) within a valve body (112) and having at one end a tapered portion (113), the cross-sectional views of which are shown in FIGS. 8 and 9. The tapered end (113) comprises a plurality of tapered fluted segments (114) each having a tapering opening or cut-out provided therein (see also FIGS. 8 and 9). The tapered portion provides a fluid flow passageway and forms an orifice 115 between itself and an associated edge portion of the body 116, the cross-sectional area of which varies according to the axial displacement of the spool 110 itself. Preferably the edge 116 is a sharp edge thus allowing for the complete cessation of flow as and when the spool is appropriately positioned, but it may also comprise a chamfered edge or a radiused edge if so desired. The tapered end 113 of the spool 110 provides a frontal area Fa (acting as the opening means and first, flow confronting, surface) exposed to the pressure of any oncoming fluid from the pulsative flow source entering through inlet port 124. The FSPD 102 is further provided with a biasing means in the form of, for example, a low spring rate spring 117 acting to bias the spool in the direction of the incoming fluid. This spring may be a compression spring (as shown) or a tension spring (not shown) acting on the other end 113 of the spool 110, and may in either case react against the valve body 112. FIG. 5 shows the preferred arrangement whereby the bias means 117 is located outside the flow of fluid through the FSPD 102, on the opposite side of the spool 110 to the opening means. A pin-in-hole assembly 118 extending through the spool 110 communicates with a volume of fluid 119 trapped between the blank end 120 of the aperture 111 in the valve body 112 and the spool 110, and together these form a damping means 126. A slot or hole 121 may be provided in the spool, as shown, so as to permit fluid in the FSPD's outlet 122 to reach the pin-in-hole assembly 118, and a spool seal 123 may be provided to seal the blank ended hole 120. Alternatively the pin-in-hole assembly 118 could fluidically communicate with the inlet 124 of the FSPD.

In this arrangement fluid passing through the FSPD 102 enters through the inlet 124 into a plenum chamber 125 surrounding the spool 110 and then passes through the orifice 115 to an outlet 122, reducing the fluid pressure from inlet to outlet. Between them, the spring 117 and the damper 126 act to control the movement of the spool 110 such that pulsed loadings on the frontal area Fa caused by pulsed supply of fluid from the pulsative flow source 100 are unable to cause the spool to move more rapidly than the damper allows, but slow movement is accommodated as the time-averaged flow rate of the pulsative flow source increases.

FIGS. 6 and 7 illustrate different profiles applied to the spool 110. From these figures it will be appreciated that the profile may have a parabolic profile (FIG. 6) or may be otherwise profiled such as shown in FIG. 7 which has a first portion P1 having a relatively gentle slope and correspondingly gentle orifice opening speed and a second portion P2 having a steeper slope which provides a more rapid increase in outlet size for a given axial spool movement. Variations and combinations of these profiles will present themselves to those skilled in the art.

Operation

Operation of the above-mentioned arrangement will now be described such as to allow the reader to appreciate the advantages associated therewith. Referring now once again to FIG. 4, a pulsed supply of fluid is sent from flow source 100 and supplied to the FSPD 102 which controls the flow of fluid to the fluid consumer 103.

Figure 10:
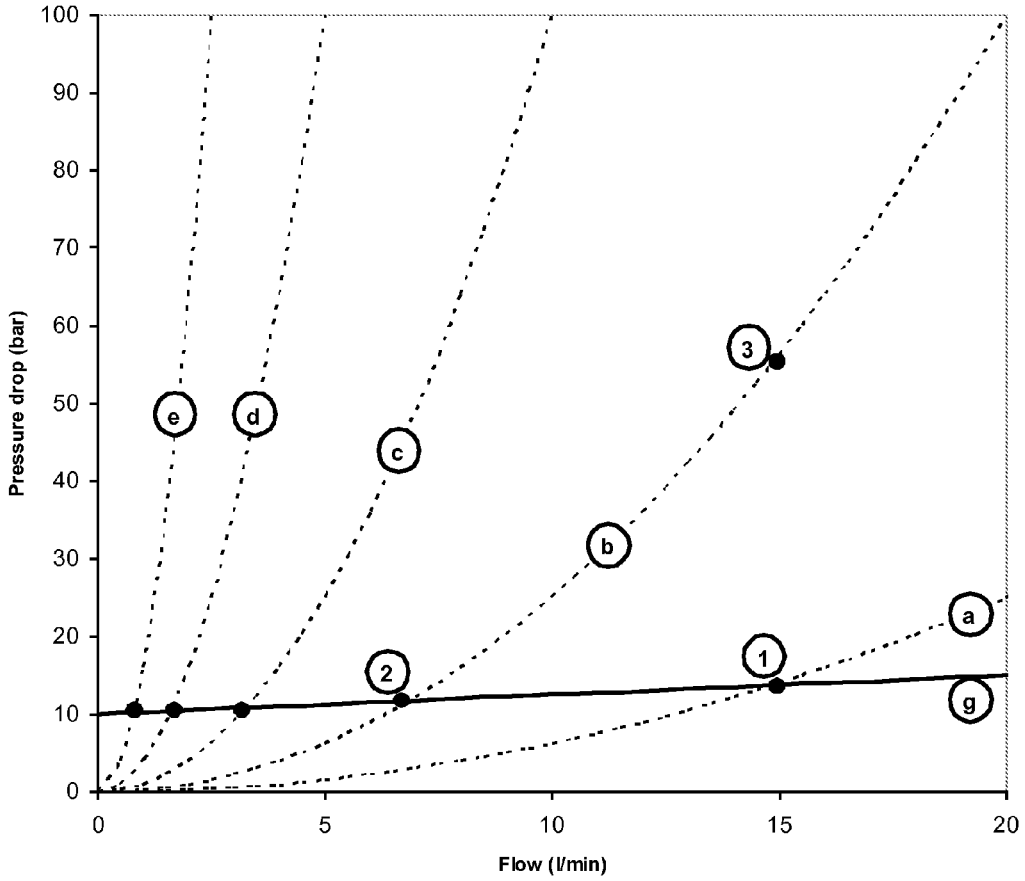
FIG. 10 is a diagrammatic illustration of the behaviour of the frequency sensitive pressure drop of FIG. 5.

The FSPD 102 has the characteristic shown diagrammatically in FIG. 10. Under steady flow, the loss of fluid pressure across the FSPD is low and varies only a little with changing flow—shown as line 'g'. For example, if the flow is 7 l/min then the pressure drop is 11 bar (point '2'). If the flow increases slowly to 15 l/min, the pressure will rise slightly to 12 bar (point '1') and the spool 110 will be open further. However, if the flow increases suddenly to 15 l/min, the spool cannot move immediately because its movement is damped by the damper 126. The pressure drop through the valve is now determined by the orifice characteristic operating curve 'b', and the pressure rises to 55 bar. If the flow through the valve remains at 15 l/min, the spool will slowly open and the pressure drop will reduce until the valve is finally operating at point '1' where the pressure drop is 12 bar.

Thus, when starting from a steady flow at point '2', a rise in flow will cause an increase in pressure as shown by curve 'b' if the rise is instant, and as shown by line 'g' if the rise is slow. At intermediate rates of flow increase, the increase in pressure will be intermediate between these values. When subject to a sudden flow increase from lower steady flows, the pressure/flow characteristic will follow the orifice characteristic curves 'e', 'd' and 'c'.

The first compliance 105 is crucial to the operation of the invention. With no first compliance 105 then the flow rate out of the FSPD 102 would equal the flow rate into the FSPD, regardless of the pressure drop through the FSPD, and there would be no attenuation of flow pulses 80. However, when provided, the first compliance 105 will act to absorb fluid from connecting line 101 as the pressure drop increases and then emit it over a longer time period. The damping rate of the damping means 126 and the first fluid compliance 105 together determine the time constant of the restrictor 110 movement—that is, the time taken after a step change of flow for the restrictor to move 63% of the distance towards its steady-state position.

The FSPD might also have included a ball and spring pressure relief valve arranged within the spool 110 or valve body 112. This pressure relief valve would reduce the resistance to movement when the pressure difference between the volume of trapped fluid 119 and the slot 121 exceeded a certain threshold in one or both directions, which would allow the fluid system to respond more rapidly to very large flow changes while still filtering pulses and small flow changes.

Choice of Damping Rate and Compliance

The correct choice of damping rate and first fluid compliance 105 size must ensure that the time constant of the restrictor 110 movement is longer than the time between adjacent flow maxima 86 and minima 85 (Ta), or the time between adjacent flow minima 85 (Tb), or the repeating period Tf of the flow pattern 81,82,83,84. The time constant of the restrictor 110 movement must also be shorter than the reciprocal of the desired maximum control bandwidth at the hydraulic consumer 103. For example, for a hydraulic excavator requiring 1/Ts=4 Hz bandwidth (therefore Ts=250 ms) driven by a pulsative flow source 100 comprising a fixed displacement pump modulated by an on/off valve operating at 40 Hz (period Tf=25 ms), the time constant of the restrictor should lie between 25 ms and 250 ms so that the flow output of the FSPD will track the average flow demand but will not respond significantly to the flow pulsation 80. In another example, for the same hydraulic excavator driven by a pulsative flow source 100 comprising the Digital Displacement Pump shown in FIG. 1, rotating at 1500 RPM and operated to produce the flow patterns shown in FIG. 3, the period Tf is 40 ms so the time constant of the restrictor should lie between 40 ms and 250 ms to ensure that the flow output of the FSPD will track the average flow demand but will not respond significantly to the flow pulses 80.

It is possible that the pulsation period of the flow source 100 is variable and that the desired control bandwidth is variable depending operating mode selected by the operator or detected by the controller. Hence, the restrictor time constant may lie between the lowest frequency of the pulsating flow source and the highest required control bandwidth.

Advantageous Features

The controller 12 may have a number of advantageous features incorporated therein. It may filter a human or machine operator's demand signal so as to limit the rate of change of the command signal which is sent to the flow source 1,100. It may act as an electronic pressure limiter, limiting the fluid pressure generated by the flow source to below the setting of a relief valve incorporated somewhere in the fluid system, either using a pressure sensor to sense the pressure directly or by inferring the pressure from the pressure measured at the hydraulic consumer 103 and an estimate of pressure drop across the FSPD 102 based on the fluid system's known characteristics and the time history of fluid flow from the flow source. Or the controller may modify the signal sent to the flow source to achieve a desired pressure at the hydraulic consumer by compensating for the known characteristics of the FSPD and compliances 105,106 (i.e. a leading controller).

As well as controlling the flow source to achieve the aforementioned advantageous features in the manner just described, the controller could also adjust the damping means and biasing means during operation. Such control could be synchronised to the flow source, for example the pumping, idling or motoring cycles of the Digital Displacement Pump/Motor.

Systems with a Plurality of Valves

Figure 11:
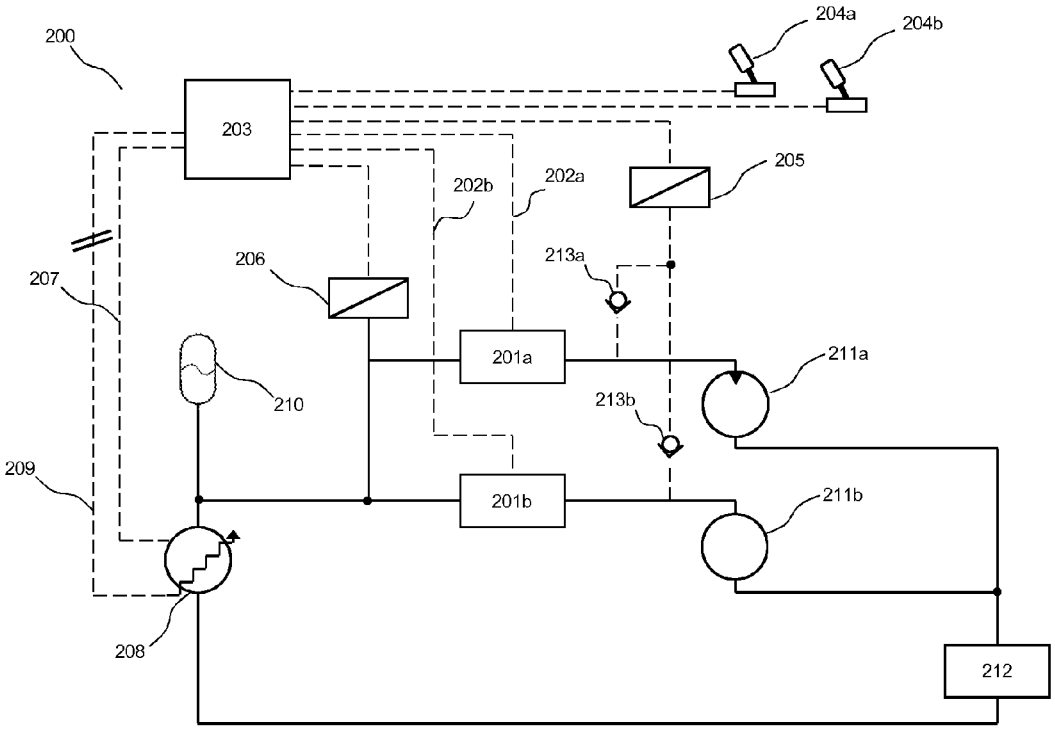
FIG. 11 is an illustration of a fluid system comprising two hydraulic loads with separate frequency sensitive pressure drops.

FIG. 11 shows a fluid working system (200) comprising two FSPDs (201*a*,201*b*) (functioning as dual-mode valves) controlled by individual electronic control lines (202*a*,202*b*) adjusting the damping and bias under the control of a system controller (203). The system controller receives inputs from two operator levers (204*a*,204*b*), a load sense pressure transducer (205), a pump pressure transducer (206) and a shaft sensor signal line (207) indicating the speed and position of the shaft of a Digital Displacement Pump (208) (acting as the source of hydraulic fluid). The system controller controls the Digital Displacement Pump through a multitude of valve control lines (209). The Pump provides flow to an accumulator (210) (acting as the first fluid compliance) and to the two FSPDs. The FSPDs in turn provide flow to respective hydraulic motors (211*a*,211*b*) (acting as hydraulic fluid consumers) which return fluid to a tank (212). Load sense check valves (213*a*,213*b*) ensure that the load sense pressure transducer measures the maximum of the fluid pressures provided to the respective hydraulic motors.

When either operator lever is active the system shown in FIG. 11 works the same as previously described with reference to the earlier figures: the relevant FSPD is controlled to exhibit a damped restrictor behaviour and together with the compliance blocks rapid flow changes but admits slow flow changes to the respective motor, and the controller adjusts the Digital Displacement Pump's flow according to the operator lever position. However, when both operator levers are simultaneously active the controller controls one or both of the FSPDs in an additional mode in which the controller adjusts the flow therethrough. The controller adjusts the Digital Displacement Pump's flow to maintain the pump pressure (sensed by the pump pressure transducer) a certain margin above the highest load pressure (sensed by the load sense pressure transducer), and the FSPDs reduce the fluid pressure to distribute the flow according to the controller's signals, which are determined from the operator levers. The direct control of flow through the FSPDs isolates flow pulses from the motors, although where the two motors need different pressures energy will be lost and the system will be less efficient. Accordingly, the frequency selective pulse dampening effect of the invention is maintained in both modes, while when just one operator lever is active the system operates with maximum energy efficiency.

It would also be simple to incorporate the FSPDs into directional control valves which are commonly used to change not just the flow, but also swap the direction of flow through each of two hydraulic lines leading to the same hydraulic actuator. In this way the number of separate components is reduced, while achieving the desirable pulse dampening effect of the invention.

The invention claimed is:

1. A fluid system comprising:

a. a source of hydraulic fluid under pressure, said source producing in use a varying flow comprising a plurality of local flow maxima and local flow minima, wherein adjacent maxima and minima are separated by at least a minimum time (Ta);

b. a controller for controlling said source;

c. a hydraulic fluid consumer;

d. a valve passing fluid between said source and said fluid consumer, wherein the valve comprises a valve body having an aperture and an edge portion and a spool axially displaceable within said aperture;

e. a first fluid compliance between said source and said valve;

f. the spool being a variable restrictor for smoothly and continuously varying a cross sectional area available for flow of fluid through said valve and movable between a first position with a larger said area and a second position with a smaller said area, said spool having a tapered portion including a plurality of tapered fluted segments each having a tapered opening forming an orifice between itself and the edge portion of the body and each orifice having a cross-sectional area which varies according to the axial displacement of the spool;

g. a bias means for biasing said restrictor towards said second position, said bias means providing a substantially constant biasing force;

h. an opening means for urging said restrictor against said bias means when fluid flows through said valve, such that under steady flow, a pressure drop across said valve is low and varies little with changing flow; and i. a damping means for damping movement of said restrictor between said first and second positions and providing a resistance which increases with a velocity of displacement of said restrictor, characterized in that a time constant (Tr) of the damped movement of said restrictor is longer than said minimum time (Ta).

2. The fluid system of claim 1, wherein said source comprises a plurality of working chambers connectable to and isolatable from said valve, thereby to cause said source to produce a varying flow comprising a plurality of local flow maxima and local flow minima, wherein said controller is operable to add working chambers to and delete working chambers from a set of working chambers connected to said valve no more frequently than an interval (Td), characterized in that the time constant (Tr) of the damped movement of said restrictor is longer than said interval (Td).

3. The fluid system of claim 1, wherein said source comprises a plurality of working chambers which produce flow pulses separated by a non-zero minimum time (Tp), characterized in that the time constant (Tr) of the damped movement of said restrictor is longer than said non-zero minimum time (Tp).

4. The fluid system of claim 1, wherein said source produces a varying flow comprising a plurality of local flow maxima and local flow minima formed by a summation of flow pulses, each of said flow pulses having a maximum length (Tc), characterized in that the time constant (Tr) of the damped movement of said restrictor is longer than said maximum length (Tc).

5. The fluid system of claim 1, wherein said source is a pulsative flow source producing in use a varying flow comprising a plurality of local flow maxima and local flow minima, and producing in use one or more short repeating flow patterns, each having the same average flow and having a maximum period (Tf), characterized in that the time constant (Tr) of the damped movement of said restrictor is longer than said maximum period (Tf).

6. The fluid system of claim 1, wherein at least one local flow minimum is substantially zero.

7. The fluid system of claim 1, wherein said source is a variable flow source producing in use a time-averaged output flow, said time averaged output flow following a demand signal and having a maximum bandwidth (1/Ts), wherein the time constant (Tr) of the damped movement of said restrictor is less than said maximum bandwidth (Ts).

8. The fluid system of claim 1, wherein said fluid consumer comprises one or more motors or actuators.

9. The fluid system of claim 1, further comprising a second fluid compliance between said valve and said fluid consumer.

10. The fluid system of claim 9, wherein said first and second fluid compliances each comprise an accumulator.

11. The fluid system of claim 1, wherein said spool comprises a first, flow confronting surface of fixed cross-sectional area and a variable outlet area at a second end thereof, the area of which depends upon the axial position of said spool relative to the valve body, thereby to create a variable pressure drop across said valve.

12. The fluid system of claim 1, wherein said biasing means comprises a spring.

13. The fluid system of claim 1, wherein any of said biasing means, said damping means, or said opening means comprises an electronically controlled actuator, a solenoid/electromagnetic actuator, a piezoelectric actuator, an electrorheological device, or a hydraulic amplifier.

14. The fluid system of claim 1, wherein said valve is a dual-mode valve operable at least some of the time to control the flow of fluid therethrough, and wherein said dual-mode valve is connected to said hydraulic consumer.

15. The fluid system of claim 1, wherein said source comprises a plurality of working chambers of cyclically varying volume controlled on a stroke-by-stroke basis by said controller, by means of high-speed commutating valves associated with each working chamber and controlled so as to vary the time-averaged proportion of working chambers which provide fluid to or from said valve.

16. The fluid system of claim 1, wherein said resistance decreases or remains substantially the same when a pressure difference between two volumes of fluid within the valve reaches or exceeds a threshold.

17. The fluid system of claim 1, further comprising at least one pressure transducer providing a pressure measurement to said controller, wherein said controller is arranged to create an estimation of the pressure drop across said valve and to use said estimation in conjunction with said pressure measurement to adjust an output of said source.

* * * * *